US007059314B1

(12) United States Patent
Teague

(10) Patent No.: US 7,059,314 B1
(45) Date of Patent: Jun. 13, 2006

(54) SLING BOW

(76) Inventor: Marshall Teague, 10720 Royal Forest Dr., Conroe, TX (US) 77303

( * ) Notice: Subject to any disclaimer, the term of this patent is extended or adjusted under 35 U.S.C. 154(b) by 0 days.

(21) Appl. No.: 11/224,207

(22) Filed: Sep. 12, 2005

(51) Int. Cl.
*F41B 3/02* (2006.01)

(52) U.S. Cl. ..... 124/20.3

(58) Field of Classification Search ..... 124/20.1, 124/20.2, 20.3
See application file for complete search history.

(56) References Cited

U.S. PATENT DOCUMENTS

| | | | | |
|---|---|---|---|---|
| 1,748,651 A | | 2/1930 | Holliday | |
| 2,613,659 A | * | 10/1952 | Hutson | 124/20.3 |
| 2,691,973 A | | 10/1954 | Hutson | |
| 2,715,895 A | | 8/1955 | Loveless | |
| 3,455,288 A | | 7/1969 | Knerr | |
| 3,494,346 A | | 2/1970 | Yount et al. | |
| 3,517,657 A | * | 6/1970 | Alban | 124/20.3 |
| 3,923,034 A | * | 12/1975 | Wolf | 124/20.1 |
| 4,198,949 A | * | 4/1980 | Cook | 124/20.1 |
| 4,265,212 A | | 5/1981 | Wolf | |
| 4,573,445 A | | 3/1986 | Webb et al. | |
| 4,873,963 A | | 10/1989 | Lemmen | |
| 4,877,007 A | | 10/1989 | Olson | |
| 5,803,067 A | | 9/1998 | Ellenburg et al. | |
| D402,731 S | | 12/1998 | Mahan | |

* cited by examiner

*Primary Examiner*—John A. Ricci
(74) *Attorney, Agent, or Firm*—Mary J. Gaskin

(57) ABSTRACT

A sling bow having a frame shaped with a handle and a Y-shaped end into which an off-center, quarter-circle shaped notch is cut, against the side of which the shaft of a conventional arrow rests before it is launched. Slots cut in the extensions of the Y-shaped end hold the ends of two straps, the opposite ends of each being connected to gripping portions which are connected to each other with a bent wire, against which the nock of the arrow is placed. The shape of the notch and the symmetry of the slots allow a shooter to launch a conventional arrow accurately.

6 Claims, 2 Drawing Sheets

SLING BOW

BACKGROUND OF THE INVENTION

The present invention relates to a compact, hand-held device for launching arrows.

The prior art discloses a number of devices for shooting conventional arrows, several which use a slingshot-like frame rather than a bow. The devices range from the simple to the complex. For a device to be useful, it must be able to launch arrows accurately. The prior art devices take different approaches, from using tubes through which the arrows fly to having retractable arrow rests. However, each of the devices has drawbacks.

There is a need for a compact sling bow which is easy to use, but which can still accurately launch conventional arrows. The sling bow should be durable, yet lightweight. The sling bow should be useable by both right-handed and left-handed sportsmen.

SUMMARY OF THE INVENTION

The present invention has a flat, generally Y-shaped frame formed with a handle on one end and the other end having two extensions separated by an off-center, arcuate notch, which is used to center an arrow. One side of the notch is aligned with the longitudinal centerline of the frame. Each extension has a slot for insertion of the knotted end of one of two elastic straps. Each opposite end of the two straps is attached to a grip portion. The grip portions are connected to each other with a bent steel wire or leather strip, which serves as a nocking point for the nock of an arrow. The gripping portions allow the shooter to pull back the straps and launch an arrow.

It is an object of the present invention to provide a sling bow having a notch that centers the arrow, allowing a conventional arrow to be launched with the same degree of accuracy as a conventional bow.

Another object of the present invention is to provide a device which is compact and lightweight, and which can be used in the brush to hunt small game.

A further object of the present invention is to provide a device which can be used for target practice and in shooting competitions.

Yet another object of the present invention is to provide a device which can be used by both right-handed and left-handed sportsmen.

Still another object of the present invention is to provide a device which is easy to assemble and use.

BRIEF DESCRIPTION OF THE PREFERRED EMBODIMENT

Figure 1:
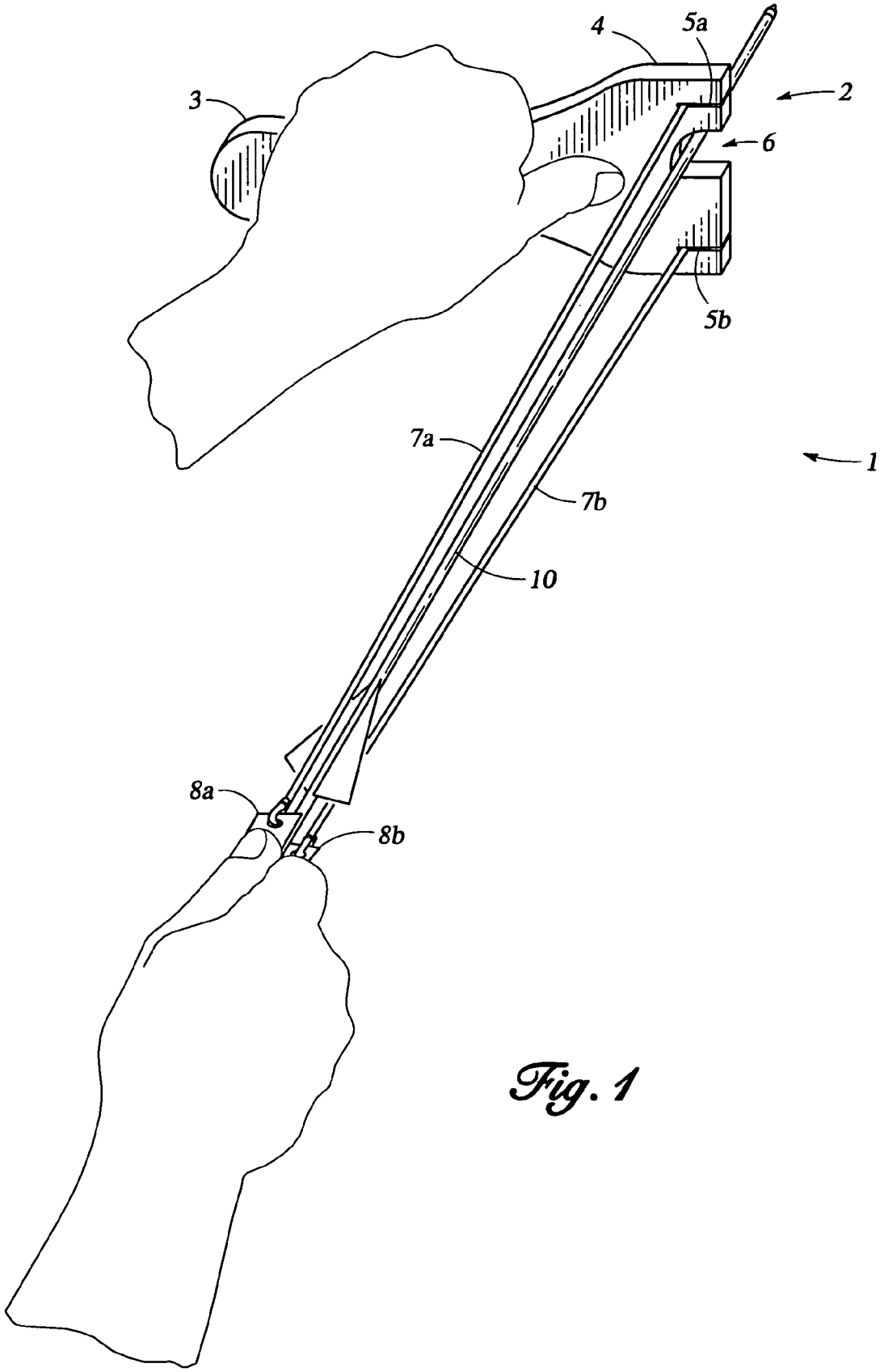
FIG. 1 is a perspective view showing the present invention being used to shoot an arrow.

As shown in FIG. 1, the sling bow 1 of the present invention has a frame 2 which is generally constructed from wood, or rigid plastic; it can also be made from a metal such as aluminum. The frame 2 is shaped with a handle 3 and a Y-shaped end 4 having extensions into which slots 5*a*, 5*b* are cut. An off-center arcuate notch 6, shaped like a quarter circle, is cut into the Y-shaped end 4 between the slots 5*a*, 5*b*; it is used to center an arrow 10 when the shooter prepares to launch it. One end of each strap 7*a*, 7*b* is inserted into one of the slots 5*a*, 5*b*, and the other end of each strap 7*a*, 7*b* is attached to one of the grip portions 8*a*, 8*b*. The straps 7*a*, 7*b* are made from an elastic, resilient material such as surgical rubber, and the grip portions 8*a*, 8*b* are generally made from a flexible material, such as leather. The shape of the notch 6 and the symmetry of the slots 5*a*, 5*b* allow a shooter to launch an arrow 10 with great accuracy.

When shooting an arrow 10, the shooter holds the frame 2 in a generally horizontal orientation, aiming the arrow by resting it on the inner edge of the notch 6. The shooter grips the end of the arrow 10 between the grip portions 8*a*, 8*b*. When used by a left-handed person, the straps 7*a*, 7*b* are removed, the frame 2 is flipped over, and the straps 7*a*, 7*b* reinserted in the slots 5*a*, 5*b*, in the opposite direction, so that the notch 6 can be properly used to center the arrow 10.

Figure 2:
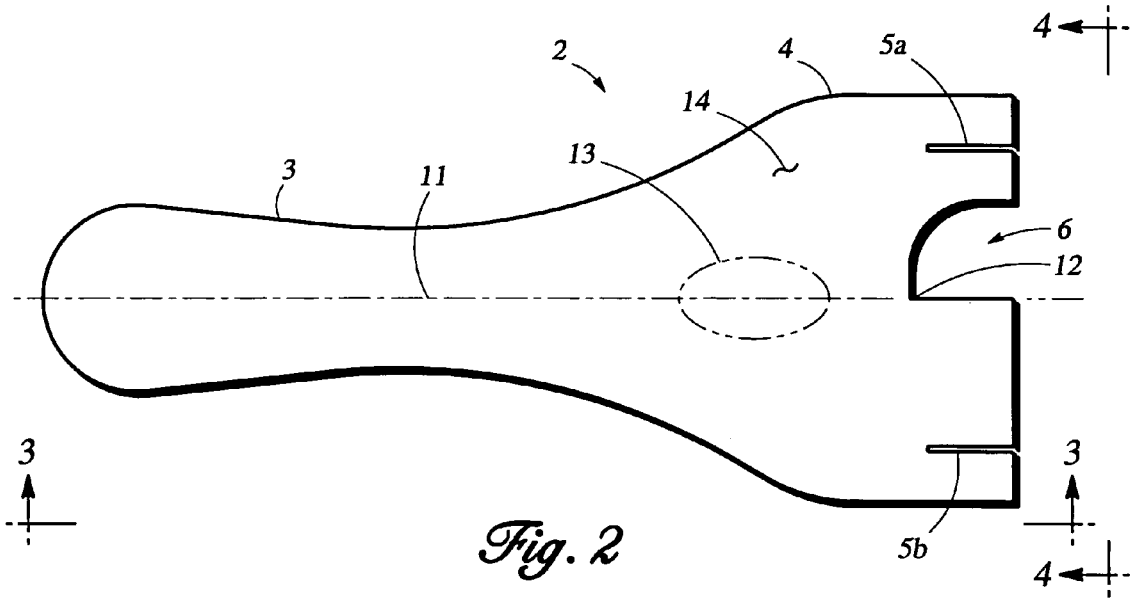
FIG. 2 is a top plan view of the frame of the sling bow of the present invention.

As shown in FIG. 2, the frame 2 has a handle 3, with a Y-shaped end 4 having slots 5*a*, 5*b*, each of which is spaced equidistant from and parallel to the longitudinal centerline 11, one on each side. The frame 2 shown is approximately 7 to 8 inches long, and is approximately 3 to 4 inches wide at the Y-shaped end 4. The notch 6 is generally shaped like a quarter circle cutout, with the straight-cut side aligned along the longitudinal centerline 11 of the frame 2. The point 12 provides a spot upon which the shooter will rest an arrow shaft when sighting his target. The spot for general placement of a shooter's thumb is shown as oval 13 on inward-facing surface 14.

Figure 3:
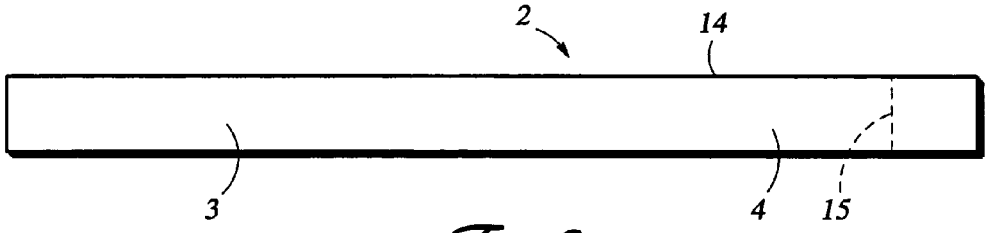
FIG. 3 is a side plan view of the frame of the sling bow of the present invention, taken along line 3—3 of FIG. 2.

FIG. 3 shows the side of the frame 2, with handle 3, Y-shaped end 4 and inner-facing surface 14. The frame 2 is approximately ½ inch thick. The dotted line 15 shows the point to which the lower ends of the slots 5*a*, 5*b* and the inner edge of the notch 6 are cut (the lower ends of the slots 5*a*, 5*b* and the inner edge of the notch 6 lie in a plane). Because the ends of the straps 7*a*, 7*b* are aligned with the point 12 upon which the arrow 10 rests, the shooter will be able to launch it accurately.

Figure 4:
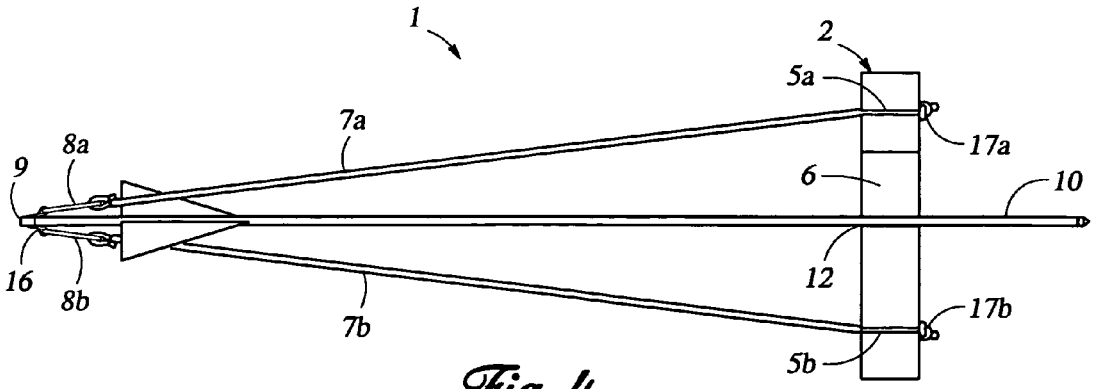
FIG. 4 is a plan view of the end of the frame showing the general arrangement of the straps and the arrow before it is launched, taken along line 4—4 of FIG. 2.

As shown in FIG. 4, when a shooter assembles the sling bow 1, the end of each of the straps 7*a*, 7*b* is knotted 17*a*, 17*b* and slid into slot 5*a*, 5*b*, respectively, of the frame 2. The opposite end of each of the straps 7*a*, 7*b* is attached to a grip portion 8*a*, 8*b*, each of which is attached to the connector 16, which is constructed from a bent steel wire or a leather strip. The nock 9 of the arrow shaft 10 is placed against the connector 16, and the shooter pulls the end of the arrow 10 back using the grip portions 8*a*, 8*b*. The arrow shaft 10 rests on point 12 of the notch 6, which allows the shooter to accurately sight his target. In use, the sling bow 1 accurately launches full size arrows (30 inches long), with between 25 to 30 pounds of thrust.

The sling bow 1 of the present invention can be used for hunting small game, for target practice, or for shooting competitions. It can be constructed from a variety of materials, to fit a range of budgets.

It will be understood that various modifications of the sling bow 1 can be made therefrom without departing from the spirit of the invention. The embodiment described herein is considered to be illustrative and not restrictive.

I claim:

1. A device for shooting an arrow having a nock and a shaft, the device comprising:

a frame having a longitudinal centerline, the frame shaped with a handle portion and a Y-shaped end with two extensions separated by a generally quarter-circle shaped notch having a straight side aligned with the centerline, each of the extensions having a slot cut therein so that the first slot and the second slot are equidistant from and parallel to the centerline;

a connector having a first end and a second end;

a first grip portion attached to the first end of the connector;

a second grip portion attached to the second end of the connector;

a first strap having a first end attached to the first grip portion and a second end with means for holding it in the first slot;

a second strap having a first end attached to the second grip portion and a second end with means for holding it in the second slot;

the nock of the arrow being placed against the connector between the first grip portion and the second grip portion, and the shaft of the arrow being placed against the notch along the side aligned with the centerline of the frame.

2. The device of claim 1 wherein the means for holding the second end of the first strap in the first slot is a knot, and the means for holding the second end of the second strap in the second slot is a knot.

3. The device of claim 1 wherein the connector is selected from the group consisting of a leather strip and a bent steel wire.

4. The device of claim 1 wherein the first slot has a lower end, the second slot has a lower end, and the notch has an inner edge along the centerline, and the lower end of the first slot, the lower end of the second slot, and the inner edge of the notch lie in a plane.

5. The device of claim 1 wherein the frame is made from a material selected from the group consisting of wood, rigid plastic, and metal.

6. The device of claim 1 where the straps are made from surgical rubber.

* * * * *